US010777049B1

(12) United States Patent
Holba et al.

(10) Patent No.: US 10,777,049 B1
(45) Date of Patent: Sep. 15, 2020

(54) STROBES AND SPEAKER-STROBES FOR A MASS NOTIFICATION SYSTEM

(71) Applicant: Honeywell International Inc., Morris Plains, NJ (US)

(72) Inventors: John Holba, Naperville, IL (US); Wilson Cheung, Long Grove, IL (US); Lena Zhang, Guangzhou (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/370,432

(22) Filed: Mar. 29, 2019

(51) Int. Cl.
*G08B 5/38* (2006.01)
*H04R 1/02* (2006.01)
*G08B 3/10* (2006.01)

(52) U.S. Cl.
CPC ..... *G08B 5/38* (2013.01); *G08B 3/10* (2013.01); *H04R 1/021* (2013.01); *H04R 1/028* (2013.01)

(58) Field of Classification Search
CPC . G08B 5/38; G08B 3/10; H04R 1/021; H04R 1/028
USPC ..... 340/331
See application file for complete search history.

(56) References Cited

U.S. PATENT DOCUMENTS

| | | | | |
|---|---|---|---|---|
| 4,320,949 | A * | 3/1982 | Pagano | G03B 17/08 219/201 |
| 6,944,312 | B2 | 9/2005 | Mason et al. | |
| 7,178,628 | B2 | 2/2007 | Gordon | |
| 7,530,425 | B2 | 5/2009 | Whitaker | |
| 7,817,810 | B2 | 10/2010 | Cheung | |
| 7,861,825 | B2 | 1/2011 | Stewart, Jr. et al. | |
| 8,198,092 | B2 * | 6/2012 | Durack | C12Q 3/00 436/63 |
| 8,485,487 | B2 | 7/2013 | Cheung | |
| 9,338,579 | B2 | 5/2016 | Haack et al. | |
| 9,565,493 | B2 | 2/2017 | Abraham et al. | |
| 9,807,496 | B1 | 10/2017 | Hecht | |
| 9,922,509 | B2 * | 3/2018 | Marien | G08B 5/38 |
| 2008/0157992 | A1 * | 7/2008 | Anderson | G08B 17/10 340/691.1 |
| 2013/0063275 | A1 * | 3/2013 | Kucala | G08B 5/38 340/815.4 |
| 2016/0035193 | A1 * | 2/2016 | Savage, Jr. | G08B 5/38 340/577 |
| 2018/0251977 | A1 * | 9/2018 | Rimmer | E04B 9/006 |

FOREIGN PATENT DOCUMENTS

| | | | |
|---|---|---|---|
| CN | 102767268 | A | 11/2012 |
| CN | 109040872 | A | 12/2018 |
| EP | 2949132 | A1 | 12/2015 |
| KR | 20080076205 | A | 8/2008 |
| KR | 200446120 | Y1 | 9/2009 |
| KR | 200447223 | Y1 | 1/2010 |
| WO | 2014114583 | A1 | 7/2014 |

* cited by examiner

*Primary Examiner* — Hirdepal Singh
(74) *Attorney, Agent, or Firm* — Brooks, Cameron & Huebsch, PLLC

(57) ABSTRACT

Devices, systems, and methods for strobes and speaker-strobes for a mass notification system are described herein. One device is comprised of a strobe assembly including a strobe and a strobe housing configured to cover at least a portion of the strobe. A plate attached to the strobe assembly can have an aperture configured to allow at least a portion of the strobe assembly to protrude through the plate.

17 Claims, 4 Drawing Sheets

STROBES AND SPEAKER-STROBES FOR A MASS NOTIFICATION SYSTEM

TECHNICAL FIELD

The present disclosure relates generally to systems, methods, and devices for strobes and speaker-strobes for a mass notification system.

BACKGROUND

A combined speaker strobe or strobe device can be configured to an ordinary ceiling tile and provide a multitude of benefits to the mass notification system of the facility within which it is installed. However, current solutions often require extra hardware, such as extension rings, back boxes for housing the wires and speaker, and suspended ceiling support brackets to ensure a proper fit between the ceiling tile and the speaker. These extra pieces of hardware not only increase the monetary costs of the system but also complicate the installation and maintenance processes.

Adjusting the support brackets can be time-consuming and tiresome, since the installer may be restricted to working from below the ceiling tile and may also need to circumvent appliances in adjacent ceiling tiles, such as lights, vents, and sprinkler heads. Hence, advanced training may be required for installation. In addition, in current embodiments, the backbox can easily become overcrowded, which complicates the process of routing wires and increases the probability of ground faults.

Therefore, conventional speaker strobes and strobes that are mounted to ceiling tiles can require considerable amounts of hardware, time, financial resources, and experience to install and maintain. The extra hardware can also put increased pressure on the tile and cause it to bend, which is an aesthetic detriment.

DETAILED DESCRIPTION

Figure 1A:
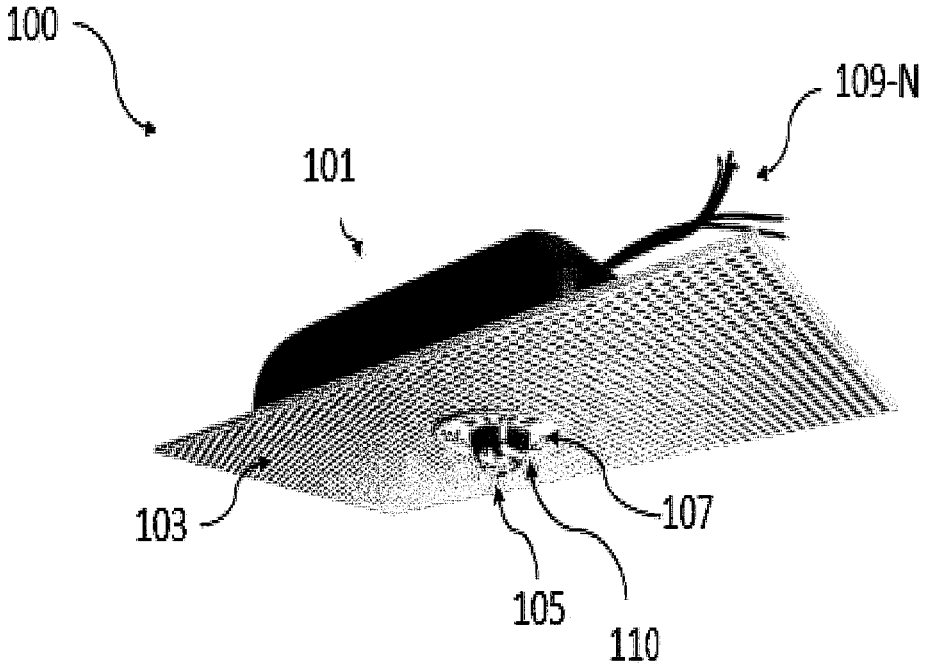
FIG. 1A illustrates a perspective view of an example device for a mass notification system in accordance with an embodiment of the present disclosure.

Systems, methods, and devices for strobes and speaker-strobes for a mass notification system are described herein. For example, an embodiment includes a strobe assembly including a strobe and a strobe housing configured to cover at least a portion of the strobe. The strobe assembly can be attached to a plate having an aperture configured to allow at least a portion of the strobe assembly to protrude through the plate.

In contrast with previous approaches, embodiments of the present disclosure can eliminate the need for additional hardware and simplify the maintenance and installation of a strobe or speaker-strobe ceiling tile by attaching a housing including one or more output devices (e.g. speakers and/or strobes) to a perforated plate.

Embodiments of the present disclosure can allow a strobe or speaker-strobe device to be assembled and wired completely before installing the device into the ceiling. In some embodiments, an already existing ceiling tile can be re-sized in order to provide room for the device. One or more elements of an already-existing ceiling suspension system can be adjusted to order to fit the device into the system. The device can then be dropped directly into its designated space.

Accordingly, embodiments of the present disclosure can allow for output devices, such as strobes and/or speakers, to be combined into a device that can replace a portion of a ceiling tile while optimizing aesthetic appearance and functionality and minimizing cost, time, and difficulty of installation and maintenance.

Embodiments of the present disclosure can also include configuring the perforated plate to allow at least a portion of a strobe to protrude through. Additionally, embodiments of the present disclosure can include additional housings for each of the output devices housed within the main housing. Each of the additional housings can be part of an assembly for the output device which is housed by the housing. For example, a strobe housing can be part of a strobe assembly that also includes the strobe itself. Embodiments of the present disclosure can include configuring a plate (e.g. a perforated plate) to allow at least a portion of the strobe assembly to protrude through.

Each additional housing can have openings through which each of the output devices can be wired. The main housing can include one or more openings through which a user can access each of the output devices and their wiring.

Embodiments of the present disclosure can allow strobes and speaker-strobe devices to be incorporated as part of a mass notification system of a facility. For example, a mass notification system can have a control unit configured to transmit instructions to a speaker and/or strobe of the device. The speaker and/or strobes can be configured to receive and execute instructions received from the control unit. Additionally, the device can include one or more access panels allowing a user to adjust one or more properties of the speaker. For example, an access panel can allow a user to adjust one or more properties of sound emitted by the speaker, including, but not limited to, input voltage, volume and pitch. An access panel can also allow a user to adjust one or more properties of the strobe. For example, an access panel can allow a user to adjust one or more properties of light emitted by the strobe, including, but not limited to, brightness and frequency of emission. An access panel can include any hardware suitable for adjusting properties of the speaker or strobe. For example, the access panel can include, but is not limited to, buttons, knobs, dials, or slide switches.

Embodiments of the present disclosure can include an attachment plate used to attach the backbox and the output devices within the backbox (e.g. speaker, strobe) to the perforated plate. For example, a speaker can be mechanically attached to the attachment plate, which can then be attached to the perforated plate. Past approaches have involved attaching a speaker directly to a perforated plate. However, these approaches do not allow for additional output elements (e.g. strobes) to be added to the device. Attaching each output device to an attachment plate can allow for multiple output devices (e.g. a speaker, strobe) to be combined into a ceiling tile.

As referenced in the present disclosure, the term "speaker" can refer to any device which can be configured to produce audio output. A "speaker" as described herein can be configured to convert electromagnetic waves into sound waves. For example, a speaker can be configured to convert analog audio signals into equivalent air vibrations in order to produce audible sound. In accordance with embodiments of the present disclosure, a speaker can be controlled by a control unit of a mass notification system. A speaker can also be a component of a public address (PA) system. A speaker can also be configured to relay an input received from a microphone.

As referred to in the present disclosure, the terms "strobe" and "strobe light" can be used interchangeably and can refer to any device that can be configured to emit light or flash light intermittently. A strobe can be an output device which is a component of a mass notification system. For example, a strobe can be configured to alert occupants of a facility of an emergency situation by emitting light intermittently.

The term "mass notification system" can be used to refer to the mass notification system of a facility (e.g., a building), such as, for instance, a large facility having a large number of floors, such as a commercial facility, hospital, school, office building, and the like. However, embodiments of the present disclosure are not limited to a particular type of facility. The mass notification system may include a number of components located throughout the facility (e.g., on different floors of the facility). A mass notification system may also include a control unit such as a physical control panel (e.g., box) installed in the facility that can be used by a user to directly control the operation of the components of the mass notification system. In some embodiments, the mass notification system can include a non-physical control unit or a control unit located remotely from the facility.

An example of a mass notification system can be a "fire safety system." For example, a fire safety system may include sensors (e.g., smoke detectors) that can sense a fire occurring in the facility, alarms (e.g., speakers, strobes, etc.) that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other components. A fire safety system may also include a control unit such as a physical fire control panel (e.g., box) installed in the facility that can be used by a user to directly control the operation of the components of the fire safety system. In some embodiments, the fire safety system can include a non-physical control unit or a control unit located remotely from the facility.

Additionally, as referenced herein, the term "housing" or "backbox" can be used to describe any component of a device suitable for housing one or more other components of the device. Hence, the term "backbox" can be used interchangeably with the term "housing." For example, in this disclosure, the term "backbox" can be used to refer to any portion of a device which can be configured to house at least one of a speaker, a strobe, and a group of wires connected to the speaker and a strobe. The backbox need not enclose the components which it houses on all sides. Rather, in some embodiments, it can be attached to one or more plates. The backbox can also have one or more openings through which wires can protrude. In addition, the backbox can have one or more openings configured to allow a user to access the components housed within the backbox.

As referenced herein, the term "housing" can be used to describe any device suitable for covering or containing at least a portion of at least one other device. For example, a "housing" can be part of an assembly.

As referenced herein, the term "assembly" can be anything comprising an output device and a housing for that output device. For example, a strobe assembly can include a strobe and a strobe housing configured to cover at least a portion of the strobe. As an additional example, a speaker assembly can include a speaker and a speaker housing configured to cover at least a portion of the speaker.

As referred to in the present disclosure, the term "ceiling" can be used to describe any overhead, interior surface designed to cover the upper limits of a room within a facility. A "ceiling" can be a secondary ceiling hung below a main structural ceiling in order to, for example, conceal building infrastructure, improve the overall environmental quality of the room, or increase environmental sustainability of a facility.

As referred to in the present disclosure, the term "attached" can be used to describe any two elements that are connected either directly or through an additional element. For example, a strobe assembly can be attached to a plate via an attachment plate, wherein the attachment plate is attached directly to the strobe assembly.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 101 may reference element "01" in FIGS. 1A and 1B, and a similar element may be referenced as 201 in FIG. 2.

As used herein, "a", "an", or "a number of" something can refer to one or more such things, while "a plurality of" something can refer to more than one such things. For example, "a number of devices" can refer to one or more devices, while "a plurality of devices" can refer to more than one device. Additionally, the designator "N", as used herein, particularly with respect to reference numerals in the drawings, indicates that a number of the particular feature so designated can be included with a number of embodiments of the present disclosure. This number may be the same or different between designations.

FIG. 1A illustrates a perspective view of an example device 100 for a mass notification system in accordance with an embodiment of the present disclosure. In some embodiments, the device 100 can be configured to replace a portion of a ceiling tile. The device 100 can include a housing (e.g., backbox) 101 attached to a perforated plate 103 and including (e.g., acting as a housing for) a strobe 105 and/or a speaker (not shown in FIG. 1A), and a number of wires 109-N connected to the strobe and/or speaker. For instance, in some embodiments, device 100 may include strobe 105 but not a speaker (e.g., device 100 may be a strobe device), and in some embodiments device 100 may include both strobe 105 and a speaker (e.g., device 100 may be a speaker-strobe device). Further, although wires 109-N are shown as outside housing 101, in some embodiments wires 109-N may be located (e.g., tucked) inside of housing 101.

The backbox 101 can be any shape and/or material configured to house a strobe or a speaker and a strobe. The backbox 101 can have one or more openings through which the contents of the backbox 101 can be accessed by a user, such as an installer or maintenance technician. In addition, the backbox 101 can have a number of openings through which the number of wires 109-N can protrude and be accessed by the user.

As shown in FIG. 1A, a portion of the strobe 105 can protrude through the perforated plate 103. The backbox 101 can be positioned behind the perforated plate 103 so as not to be visible from below the perforated plate (e.g., so as not to be visible to someone standing on the ground).

The perforated plate 103 can be any plate that allows sound to pass from a speaker through the plate 103 (e.g., a speaker grille). The perforated plate 103 can be formed from any suitable type of material. For example, the perforated plate 103 can be formed from materials including, but not limited to, metal, wood, plastic, cloth, or foam. The material can be arranged in any manner which allows sound to pass through. For example, the perforated plate 103 can have a number of holes through which the sound passes. The perforated plate 103 can also be made, for example, out of sections of material which are crosshatched together, equally spaced, or configured to form a grating.

The perforated plate 103 can have an aperture (e.g., opening) 110 through which at least a portion of the strobe 105 can protrude. In some embodiments, the opening may be lined with a label 107 identifying the device 100 as a mass notification device in accordance with industry regulations. For example, the label 107 can identify the device 100 as a fire safety device in accordance with fire safety regulations. The protruding portion of the strobe 105 can be the portion of the strobe configured to emit light.

In some embodiments, the device 100 can be configured to receive and execute instructions from a control unit of a mass notification system, such as, for instance, control unit 332 described in connection with FIG. 3. The control unit of the mass notification system can be configured to receive an indication of an emergency within the facility, and transmit instructions to the device 100 to perform one or more actions responsive to receiving the indication of the emergency. For example, the actions to be performed by the device 100 can include, but are not limited to, causing the speaker to emit a sound of a particular volume and/or frequency, and/or causing the strobe 105 to emit flashes of light.

The control unit can also be configured to receive an indication that the emergency has subsided and transmit instructions to the device 100 to terminate the performance of any actions performed in response to receiving the original indication of the emergency. In some embodiments, the control unit may be a physical panel located in the same facility as the device 100. In other embodiments, the control unit may be located remotely from the facility.

In some embodiments, data may be transmitted from the control unit to the speaker through wires that are unique to the speaker. Likewise, data may be transmitted from the control unit to the strobe through wires that are separate from the wires used to transmit data from the control unit to the speaker. In other embodiments, a common wire may transmit data to and from the control unit and the speaker and strobe 105.

Figure 1B:
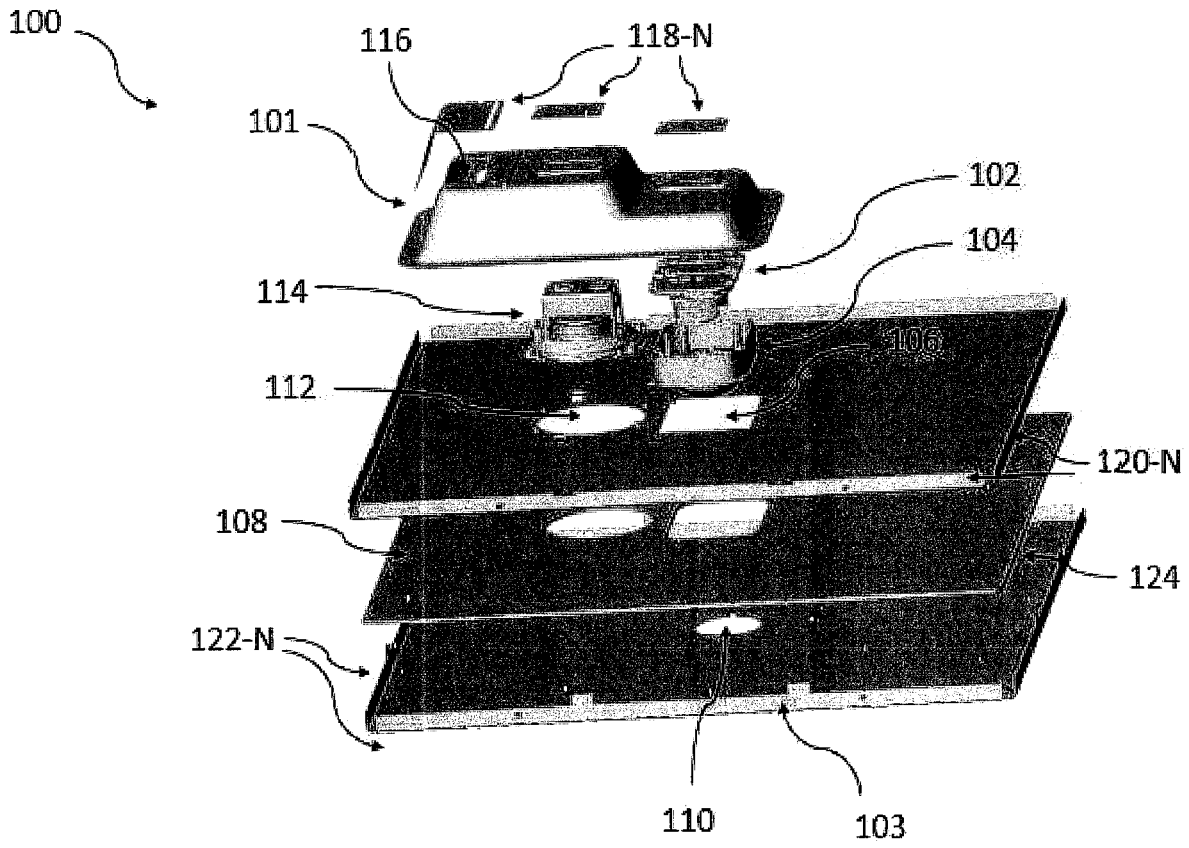
FIG. 1B illustrates an expanded view of the example device illustrated in FIG. 1A.

FIG. 1B illustrates an expanded (e.g., exploded) view of the example device illustrated in FIG. 1A. As described in accordance with FIG. 1A, a device 100 can include a perforated plate 103, an opening 110 in the perforated plate through which a portion of a strobe can protrude, and a backbox 101 configured to act as a housing for a strobe, or a speaker and a strobe, and a number of wires 109-N connected to the strobe and/or speaker.

The perforated plate 103 can be mechanically attached to the backbox 101 via an attachment plate 108, which is attached to the backbox 101. The attachment plate 108 can have an aperture (e.g., opening) 106 through which the portion of the strobe protruding through opening 110 also protrudes through. This opening 106 can be aligned with opening 110. The attachment plate 108 can also have an opening 112 through which at least a portion of the speaker protrudes through. This can allow sound to pass directly from a speaker driver (e.g., face of the speaker) through the perforated plate 103.

As shown in FIG. 1B, the device can include a speaker housing (e.g., sub-assembly) 114 for the speaker of the device within backbox 101 in embodiments in which the device is a speaker-strobe device. In such embodiments, the speaker and speaker housing 114 can be referred to as a speaker assembly. Although portions of the speaker can be contained within the speaker housing 114, in some embodiments, the speaker can have a driver which is not covered by housing 114, allowing sound to pass from the speaker through the perforated plate 103 without obstruction.

Portions of the speaker housing 114 can be mechanically attached to the attachment plate 108. Additionally, as shown in FIG. 1B, the device can include a strobe housing (e.g., sub-assembly) 102 for the strobe of the device within backbox 101 that includes a printed circuit board 104. The strobe and strobe housing 102 can be referred to herein as a strobe assembly. Portions of the strobe housing 102 and/or portions of the printed circuit board 104 can be attached to the attachment plate 108. Portions of the strobe can be contained within the strobe housing 102.

The attachment plate 108 can be formed from any suitable material. In some embodiments, the attachment plate 108 can be a lighting trim. The attachment plate 108 can be sized and configured to fit within the perimeter of the perforated plate 103. The attachment plate 108 can be attached to the perforated plate via a number of edges (e.g., deformed edges) 120-N of the attachment plate 108. The perforated plate 103 can have a number of edges 122-N configured to mate with the one or more edges 120-N of the attachment plate 108.

In some embodiments, the attachment plate 108 can be attached to the perforated plate 103 via a number of mechanical fasteners of the attachment plate. For example, the number of edges 120-N of attachment plate 108 can include a number of apertures configured to align with a number of apertures located on the number of edges 122-N of the perforated plate 103. The mechanical fasteners can be placed through these apertures to attach the perforated plate 103 to the attachment plate 108.

In some embodiments, the attachment plate 108 can be attached to the perforated plate 103 by deforming one or both of the edges 120-N of the attachment plate 108 and the edges 122-N of the perforated plate 103 so that the edges 120-N of the attachment plate and the edges 122-N of the perforated plate hold to each other. For example, the edges 120-N of the attachment plate 108 can be flattened, and the edges 122-N of the perforated plate 103 can be folded over the flattened edges 120-N of the attachment plate 108.

In some embodiments, an insulator 124 can be positioned (e.g., inserted) between the attachment plate 108 and the perforated plate 103. The insulator 124 can be formed from any suitable materials that can be positioned between the attachment plate 108 and the perforated plate 103. The insulator 124 can increase energy efficiency by reducing the amount of heat flowing from above the ceiling to the room below. The insulator 124 can have openings aligned with openings 106 and 112 and configured to allow a portion of the strobe or strobe and speaker to protrude through.

The attachment plate 108 can be mechanically attached to the backbox 101. The attachment plate 108 can also be attached to the speaker and/or the strobe 105 through a speaker housing 114 and/or a strobe housing 102, respectively. In some embodiments, the strobe housing 102 may include a printed circuit board 104 corresponding to the strobe. In some embodiments, the printed circuit board 104 can be a flat, insulating sheet configured to connect the strobe to an electronic or integrated circuit.

The device can include one or more access panels configured to allow a user to access the speaker and/or strobe 105 to adjust a number of properties of the strobe and/or speaker from below the device (e.g., on the ground). For example, properties to be adjusted can include, but are not limited to, a frequency of sound emitted from the speaker, a volume of sound emitted from the speaker, an interval of time to pass between flashes of light emitted from the strobe 105, and/or a brightness level of flashes of light emitted from the strobe 105. For example, the device 100 can include an access panel with a number of dials for adjusting the various properties of the speaker and strobe 105. Although not shown in FIG. 1B for clarity and so as not to obscure embodiments of the present disclosure, the one or more access panels can be located on the perforated plate 103 such that the user can adjust the desired properties from below the device 100 (e.g., from the ground).

The backbox 101 can include one or more slidable members 118-N configured to cover or uncover an opening therein, such as opening 116. These slidable members 118-N can allow a user to access the contents of the backbox 101 through an opening such as opening 116. In some embodiments, a wall can be positioned between the opening 116 and the speaker housing 114 and strobe housing 102. Wires 109-N can protrude through the wall. Thus, the wall can allow the user to access wires 109-N while providing further protection to the strobe 105 and the speaker.

Figure 2:
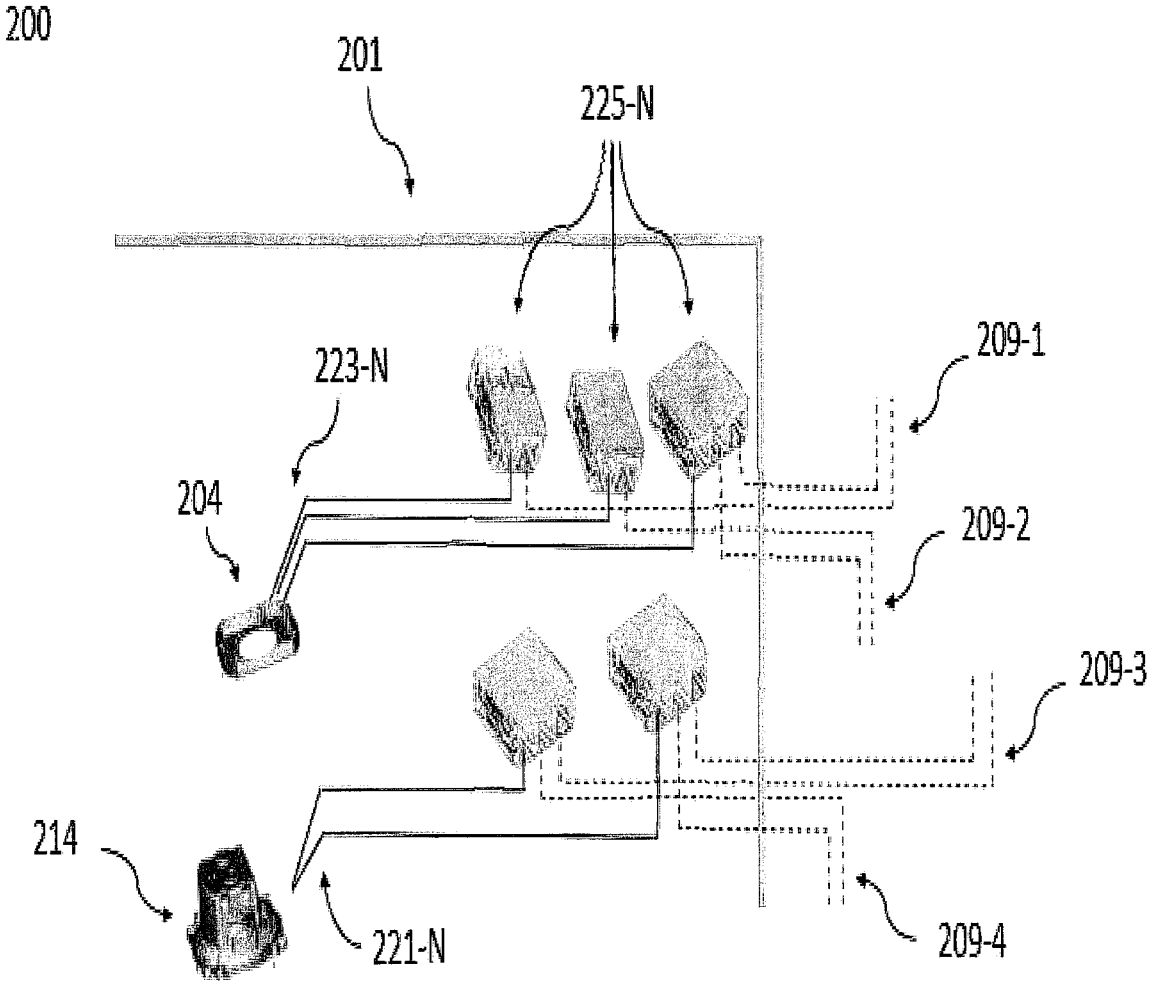
FIG. 2 illustrates an example of a wiring configuration for a device for a mass notification system in accordance with an embodiment of the present disclosure.

FIG. 2 illustrates an example of a wiring configuration for a device 200 for a mass notification system in accordance with an embodiment of the present disclosure. The device 200 can be, for example, the device 100 discussed in connection to FIGS. 1A and 1B. For instance, the backbox 201 shown in FIG. 2 can be analogous to the backbox 101 of FIGS. 1A and 1B. Likewise, the speaker housing 214 and strobe housing 202 shown in FIG. 2 can be analogous to the speaker housing 114 and strobe housing 102, respectively, discussed in accordance with FIGS. 1A and 1B. Wires 209-1, 209-2, 209-3 and 209-4 can be analogous to wires 109-N of FIG. 1A, and strobe printed circuit board 204 can be analogous to printed circuit board 104.

The strobe printed circuit board 204 contained within the backbox 201 can be connected to a number of wires 223-N. These wires 223-N can be fed through one or more quick-fit connector devices 225-N. Wires 223-N can also be fed through one or more male/female connectors. One or more strobe input wires 209-1 and strobe output wires 209-2 can protrude through an opening in the backbox 201. For example, the one or more wires 209-1 and the one or more wires 209-2 can protrude through opening 116 in FIG. 1B.

Speaker wires 221-N can be connected to the speaker through the speaker housing 214. These wires 221-N can be fed through the one or more quick-fit connector devices 225-N. Wires 221-N can also be fed through one or more male/female connectors. One or more speaker input wires 209-3 and one or more speaker output wires 209-4 can protrude through one or more openings in the backbox 201. For example, the one or more wires 209-3 and the one or more wires 209-4 can protrude through opening 116 in FIG. 1B.

In some embodiments, wires 209-1, 209-2, 209-3, and 209-4 can be wired to a terminal block located outside of the backbox 201. Wires 209-N can protrude through the backbox 201 so as not to be visible from below the device (e.g., so as not to be visible from the ground).

Figure 3:
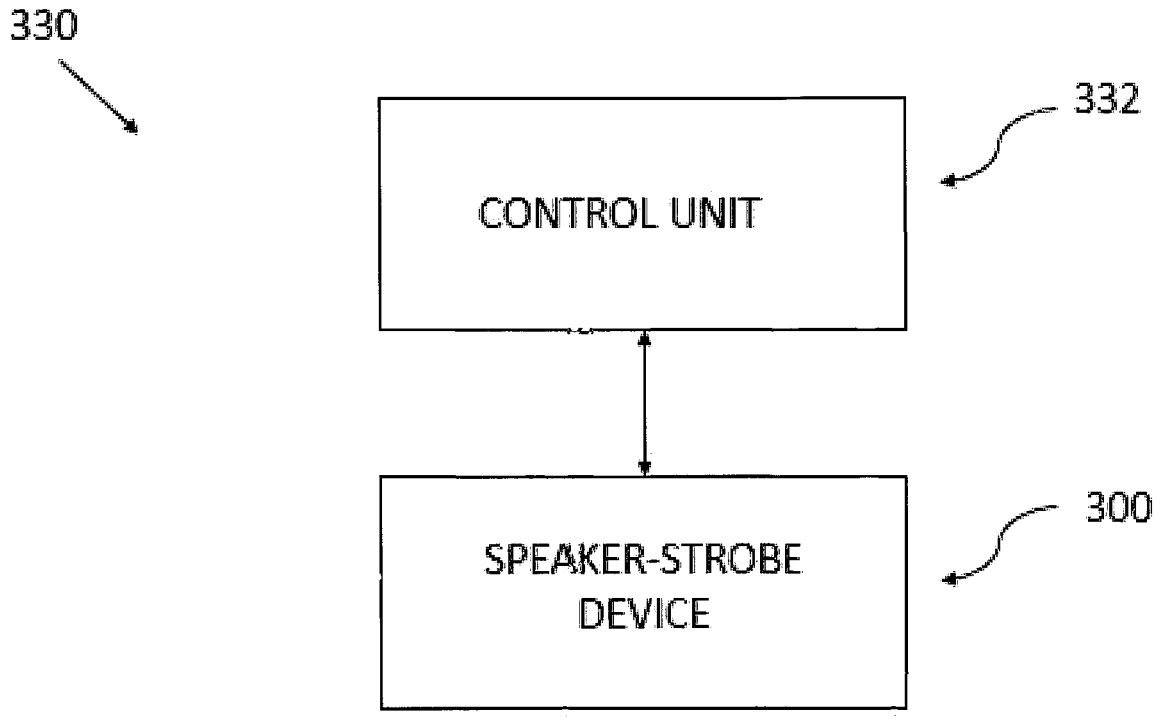
FIG. 3 illustrates a block diagram of an example system for a mass notification system in accordance with an embodiment of the present disclosure.

FIG. 3 illustrates a block diagram of an example system 330 for a mass notification system in accordance with an embodiment of the present disclosure. As shown in FIG. 3, system 330 can include device 300 and control unit 332.

Device 300 can be, for instance, device 100 previously described in connection with FIG. 1A. Control unit 332 can be, for instance, a physical panel located in the same facility as the device 300, or may be located remotely from the facility, as previously described herein.

Control unit 332 and device 300 can communicate via a wired or wireless network (not shown in FIG. 3). For example, as previously described herein, the device 300 can receive and execute instructions from control unit 332 responsive to (e.g., during) an emergency.

The network can be a network relationship through which control unit 332 and device 300 can communicate. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network can include a number of servers that receive information from, and transmit information to, control unit 332 and device 300 via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure. It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A strobe device for a mass notification system, comprising:
- a strobe assembly including:
  - a strobe: and
  - a strobe housing configured to cover at least a portion of the strobe; and
- a plate attached to the strobe assembly and having an aperture configured to allow at least a portion of the strobe assembly to protrude through the plate, wherein the plate is attached to the strobe assembly via an attachment plate that includes an additional aperture aligned with the aperture of the plate and configured to allow the portion of the strobe assembly to protrude through the attachment plate and through the aperture of the plate.

2. The device of claim 1, wherein the attachment plate includes a number of deformed edges configured to attach the attachment plate to the plate.

3. The device of claim 1, wherein the attachment plate is configured to fit within a perimeter of the plate.

4. The device of claim 1, wherein the attachment plate includes a number of mechanical fasteners configured to attach the attachment plate to the plate.

5. The device of claim 1, wherein the attachment plate is attached to the strobe assembly.

6. A speaker-strobe device for a mass notification system, comprising:
- a housing including:
  - a speaker assembly, including:
    - a speaker: and
    - a speaker housing configured to cover at least a portion of the speaker; and
  - a strobe assembly, including:
    - a strobe; and
    - a strobe housing configured to cover at least a portion of the strobe; and
- a perforated plate attached to the housing and having an aperture configured to allow at least a portion of the strobe assembly to protrude through the perforated plate, wherein the perforated plate is configured to allow sound from the speaker to pass through the perforated plate, and wherein the perforated plate is attached to the housing via an attachment plate.

7. The device of claim 6, wherein the device includes an access panel configured to allow a user to access the strobe or speaker to adjust a number of properties of the strobe or the speaker.

8. The device of claim 7, wherein the number of properties of the strobe or the speaker include at least one of:
- a frequency of sound emitted from the speaker;
- a volume of sound emitted from the speaker;
- an interval of time to pass between flashes of light emitted from the strobe; and
- a brightness level of flashes of light emitted from the strobe.

9. The device of claim 6, wherein the housing includes one or more openings configured to allow a user to access a number of wires connected to one or both of the speaker and the strobe.

10. The device of claim 9, wherein the housing includes one or more slidable members configured to cover or uncover the one or more openings.

11. The device of claim 6, wherein the housing is positioned so as not to be visible from below the device.

12. The device of claim 6, wherein the attachment plate is attached to one or both of the strobe assembly and the speaker assembly.

13. The device of claim 6, wherein the device includes an insulator positioned between the attachment plate and the plate.

14. A strobe system for a mass notification system comprising:
- a control unit; and
- a device configured to receive and execute instructions from the control unit and comprising:
  - a housing including:
    - a strobe assembly, including:
      - a strobe; and
      - a strobe housing configured to cover at least a portion of the strobe; and
  - a perforated plate attached to the housing and having an aperture configured to allow at least a portion of the strobe assembly to protrude through the perforated plate, wherein the perforated plate is attached to the strobe assembly via an attachment plate that is configured to fit within a perimeter of the perforated plate.

15. The system of claim 14, wherein the control unit is configured to:
- receive an indication of an emergency within a facility; and
- transmit instructions to the device to cause the strobe to emit flashes of light responsive to receiving the indication of the emergency.

16. The system of claim 14, wherein the housing further includes a speaker assembly, including:
- a speaker; and
- a speaker housing configured to cover at least a portion of the speaker.

17. The system of claim 16, wherein the control unit is configured to:
- receive an indication of an emergency within a facility; and
- transmit instructions to the device to cause the speaker to perform an action responsive to receiving the indication of the emergency.

* * * * *